United States Patent [19]

Holton et al.

[11] Patent Number: 4,526,086

[45] Date of Patent: Jul. 2, 1985

[54] PISTON-CYLINDER ASSEMBLY

[75] Inventors: James A. Holton, Sheffield; James C. Inman, Rotherham, both of England

[73] Assignee: Davy-Loewy Limited, Sheffield, England

[21] Appl. No.: 388,922

[22] Filed: Jun. 16, 1982

[30] Foreign Application Priority Data

Jun. 17, 1981 [GB] United Kingdom ..... 8118605

[51] Int. Cl.[3] ..... F15B 15/26

[52] U.S. Cl. ..... 91/43; 91/44; 91/176; 91/178; 91/191; 91/217

[58] Field of Search ..... 92/29, 151; 91/1, 44, 91/45, 191, 217, 216 B, 167 R, 176, 178, 191

[56] References Cited

U.S. PATENT DOCUMENTS

| | | | |
|---|---|---|---|
| 2,531,907 | 11/1950 | Daubenmeyer | 92/29 |
| 3,133,469 | 5/1964 | Ljungberg | 92/29 |
| 3,320,861 | 5/1967 | Johnson | 92/29 |
| 3,631,762 | 1/1972 | Fuzzell | 91/217 |
| 3,638,424 | 2/1972 | Valantin | 92/136 |
| 3,884,127 | 5/1975 | Simmons | 92/151 |
| 4,041,704 | 8/1977 | Gygli | 91/1 |
| 4,103,280 | 7/1978 | Cholet | 91/44 |
| 4,143,583 | 3/1979 | Bauer | 91/1 |
| 4,205,594 | 6/1980 | Burke | 92/151 |

FOREIGN PATENT DOCUMENTS

| | | | |
|---|---|---|---|
| 2119760 | 11/1972 | Fed. Rep. of Germany . | |
| 2824635 | 12/1978 | Fed. Rep. of Germany | 92/29 |
| 2929711 | 1/1981 | Fed. Rep. of Germany . | |

*Primary Examiner*—Abraham Hershkovitz
*Attorney, Agent, or Firm*—Schwartz & Weinrieb

[57] ABSTRACT

A piston-cylinder assembly for displacing a load through a long stroke consists of a rod, a piston slidable on the rod and by fluid pressure the piston is clamped to the rod, and a cylinder in which the piston is contained. By clamping the piston to the rod and introducing fluid into the cylinder, relative movement is caused between the piston and cylinder and the rod. When one assembly is used, the movement is intermittent but, by mounting two pistons on the rod, each piston being in a separate cylinder, and by controlling the flow of fluid, the movement is continuous.

16 Claims, 8 Drawing Figures

2
4
10
6
12
15
8
20
14
24
28
26
30
23
22
a
b
16
18
32
36
34
Y
Z0
Z1
X
C
H.P.
L.P.
T 2
10
14
15
4
22
23
24

PISTON-CYLINDER ASSEMBLY

FIELD OF THE INVENTION

This invention relates to a piston-cylinder assembly which includes an elongated piston rod and where, in use, there is relative movement between the piston and cylinder of the assembly and the piston rod in the direction of length of the rod.

BACKGROUND OF THE INVENTION

In many industrial applications, it is necessary to move a load for a limited extent in a straight line. Very often a piston-cylinder device in the form of a ram is used for this purpose. One difficulty with using a piston-cylinder device is that, in normal circumstances, the stroke of the piston-cylinder device has to be at least as long as the distance through which the load is to be moved. As soon as the stroke of a piston-cylinder device exceeds about one meter, difficulties arise in supporting the piston rod of the device and the cost of such a device rises rapidly as its length increases. It would be very desirable for a piston-cylinder device to have a stroke of almost indefinite length.

SUMMARY OF THE INVENTION

According to a first aspect of the present invention, a piston-cylinder assembly comprises a rod; a piston slidable on the rod and having clamping means whereby, in response to fluid pressure, the piston can be clamped to the rod; a cylinder containing at least part of the piston with provision for relative movement between the cylinder and the piston in the direction of the length of the rod, and the cylinder having two fluid ports, one adjacent each end of the cylinder.

In use, the assembly can be operated in either of two different modes. Firstly, the rod can be fixed and the piston and cylinder caused to move relative to the rod in the direction of its length. Secondly, the cylinder can be fixed and the rod caused to move relative to the cylinder in the direction of the length of the rod. In both modes of operation, the assembly can be used to move a load.

In the first mode of operation, low pressure fluid is introduced into the cylinder through one of the ports to force the piston to the opposite end of the cylinder. The piston is then clamped to the rod by way of fluid pressure and high pressure fluid is introduced into the cylinder through the other port causing the cylinder to move relative to the stationary rod and piston. When the cylinder has moved sufficiently for the piston to reach the other end of the cylinder, the high pressure fluid is removed, the piston is unclamped from the rod, and low pressure fluid is introduced into the cylinder to move the piston back to the opposite end of the cylinder ready for the next operating sequence.

In the second mode of operation, the cylinder is fixed. High pressure fluid is introduced into a first end of the cylinder after the piston has been clamped to the rod causing the piston and the rod to be displaced in the direction of the length of the rod. When the piston reaches the opposite end of the cylinder, the high pressure fluid is removed. The piston is unclamped from the rod and low pressure fluid is introduced through the opposite port to move the piston back along the rod to the first end of the cylinder.

In both modes of operation, the movement is intermittent and, although this may be satisfactory for some applications, it is not satisfactory for others.

According to a second aspect of the present invention, a piston-cylinder assembly comprises a rod; at least two pistons on the rod and each having clamping means whereby, in response to fluid pressure, the piston can be clamped to the rod; at least part of each piston being contained in a respective separate cylinder with provision for relative movement between the cylinder and the piston in the direction of length of the rod; and the cylinders being connected together and each having two fluid ports, one adjacent each end of the cylinder.

Again, the assembly can be operated in either of two different modes. Firstly, the rod is fixed and, by applying fluid in sequence to the two cylinders, the cylinders and the pistons haul themselves along the rod. Secondly, the two cylinders are fixed and, by applying fluid sequentially to the two cylinders, the pistons can cause the rod to be hauled through the assembly. In both modes of operation, a load can be connected to the movable part to be displaced thereby in the direction of the length of the rod.

In both modes of operation, it is necessary to clamp the pistons in turn on to the rod but it is arranged such that, at all times, one or other of the pistons is clamped to the rod and a piston is not unclamped from the rod until the other piston has been clamped to the rod. By controlling the supply of high pressure and low pressure fluid to the cylinders, the movement of the assembly can be made continuous.

Each cylinder conveniently has a sleeve portion which fits on to the rod and an annular portion surrounding the sleeve portion is in sealing relation with the wall of the cylinder and the clamping means is actuated by the action of fluid under pressure. The clamping means conveniently comprises a flexible sheath which surrounds the rod and closes off a recess formed in the sleeve. The high pressure fluid may be introduced into the recess through a bore in the piston with the entrance to the bore being outside the cylinder at all times. Alternatively, the recess can be in communication with the cylinder in which the piston is contained by way of a pressure intensifier whereby fluid in the cylinder, at a pressure exceeding a predetermined value, causes the pressure of the fluid in the recess to be such as to cause the sheath to grip the rod and clamp the piston thereto.

The sequence of operations of applying the hydraulic fluid under pressure of the two cylinders is conveniently controlled by a spool valve and electrical signals for operating the spool valve are obtained from means such as position detectors, which are located in the cylinders to detect the position of the piston within the cylinder, or by way of limit switches, positioned to be actuated by the movable part of the assembly, whether it be the movable cylinders or the movable rod.

When two pistons are employed, they may be identical and mounted in separate, identical, cylinders but a more compact arrangement can be obtained if the pistons are not identical and are shaped to allow one of them to overlap the other during part of the movement.

In a further embodiment, three pistons may be mounted on a rod, each piston having a part located in a separate cylinder and the supply of fluid is such that, at any one time, two of the pistons are clamped to the rod bringing about relative movement between the rod and the cylinders and, as one piston is unclamped, the previously unclamped piston becomes clamped to the rod. Again, this gives continuous movement and the capacity of the system is approximately twice that of each of the pistons in its associated cylinder.

It is convenient for the operating fluid to be hydraulic but the fluid can be air under pressure, if required.

Since there is no fluid seal needed between the piston and the rod, the surface of the rod does not have to be machined to very high tolerances. In fact, the rod can be a cable having a degree of flexibility and a smooth outer surface.

BRIEF DESCRIPTION OF THE DRAWINGS

In order that the invention may be more readily understood, it will now be described, by way of example only, with reference to the accompanying drawings, in which.

DETAILED DESCRIPTION OF THE ILLUSTRATED EMBODIMENTS

Figures 1, 2:
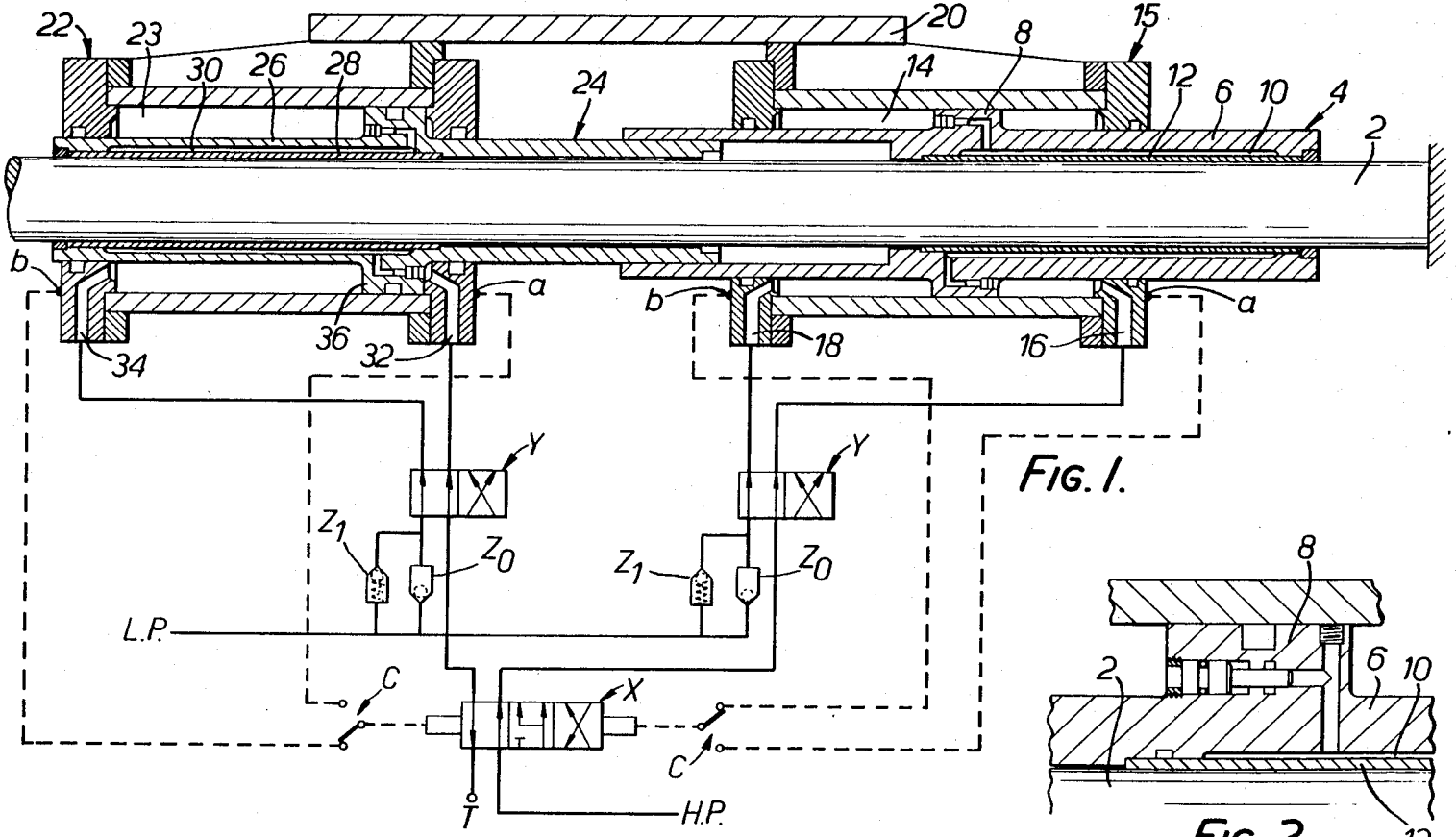
FIG. 1 is a diagrammatic side elevation of apparatus in accordance with the present invention.
FIG. 2 is a view of a pressure intensifier used in the embodiment of FIG. 1, FIGS. 3 to 7 are each the same portion of the apparatus shown in FIG. 1 but in different relative positions to each other showing how the relative movement is brought about.

A rod 2 is arranged substantially horizontal and is fixed by means (not shown). A piston 4 comprising a tubular sleeve 6 surrounds the rod 2 and is formed with an enlarged annular portion 8 midway of its length. A recess 10 formed in the piston is closed by a bronze sheath 12 which engages the rod 2. When fluid under pressure is introduced into the recess 10, the bronze sheath is caused to be deformed inwardly thereby forming a tight fit on the rod 2. Thus, the piston can slide along the rod but can also be held in any desired position on the rod by pressurising the fluid in the recess 10. The portion 8 of the piston is located within a cylinder 14 defined by a housing 15 which is slidable on the outer peripheral surface of the sleeve 6 with the outer peripheral surface of the portion 8 in sealing relation with the cylinder wall. A port 16 leading to the chamber is provided in one end wall of the housing and a similar port 18 is provided in the other end wall of the housing.

The housing 15 is connected mechanically by connecting bars, one of which is shown at 20, to a similar housing 22 which defines a cylinder 23 and is freely slidable on a piston 24 which in turn is slidable on the rod 2. The piston has a tubular sleeve 26 which is formed with a recess 30 surrounding a bronze sheath 28. By introducing fluid under pressure into the recess, the bronze sheath can be deformed inwardly, forming a tight fit on the rod, thus clamping the piston on to the rod. Ports 32 and 34 in the housing 22 enable fluid under pressure to be introduced into the cylinder 23 on either side of an enlarged annular portion 36 of the piston, the outer peripheral surface of which bears against the cylinder wall.

In the portion 36 of the piston 24 and in the portion 8 of the piston 4 there are a pair of fluid pressure intensifiers leading from the cylinder on either side of the portion 36 or 8, respectively, and extending to the recess behind the bronze sheath. When fluid in the cylinder is pressurised, the intensifier increases the pressure of the fluid in the recess and the bronze sheath is caused to deform to form a tight fit on the rod to prevent movement of the piston.

The fluid connections to the piston-cylinder assembly are as follows:

a three-section spool valve X is displaceable through each of its operating sections by electrical signals produced by a detector b associated with the left-hand end wall of each of the cylinders. Similarly a detector a is fitted in the right-hand end wall of each of the cylinders. The electrical signals from the detectors a and b connect through change-over switches c to the solenoids of the valve X. A pair of further change-over valves Y are provided and change-over from one operating position to the other is brought about either manually or by electrical means (not shown).

Fluid under high pressure of, for example, 2000 lbs/sq.in. is applied in the first position of valve X, through one of the valves Y to the right-hand port 16 of the cylinder 14. The port 32 at the right-hand end of the cylinder 23 is connected through the other valve Y and the first position of the valve X and thence to tank T. A low pressure fluid supply of, for example, 50 lbs/sq.in. is connected through a pair of non-return valves $Z_0$, connected in parallel, to each of the ports at the left-hand end of the cylinders. In parallel with each of the valves $Z_0$ there is a blow-off valve $Z_1$ which will blow-off at a pressure which can be adjusted and which is arranged to be at some convenient value greater than the pressure supplied to valves $Z_0$.

The operation of the piston-cylinder assembly will now be described with reference to the accompanying drawings.

Figures 3, 4, 5, 6, 7:
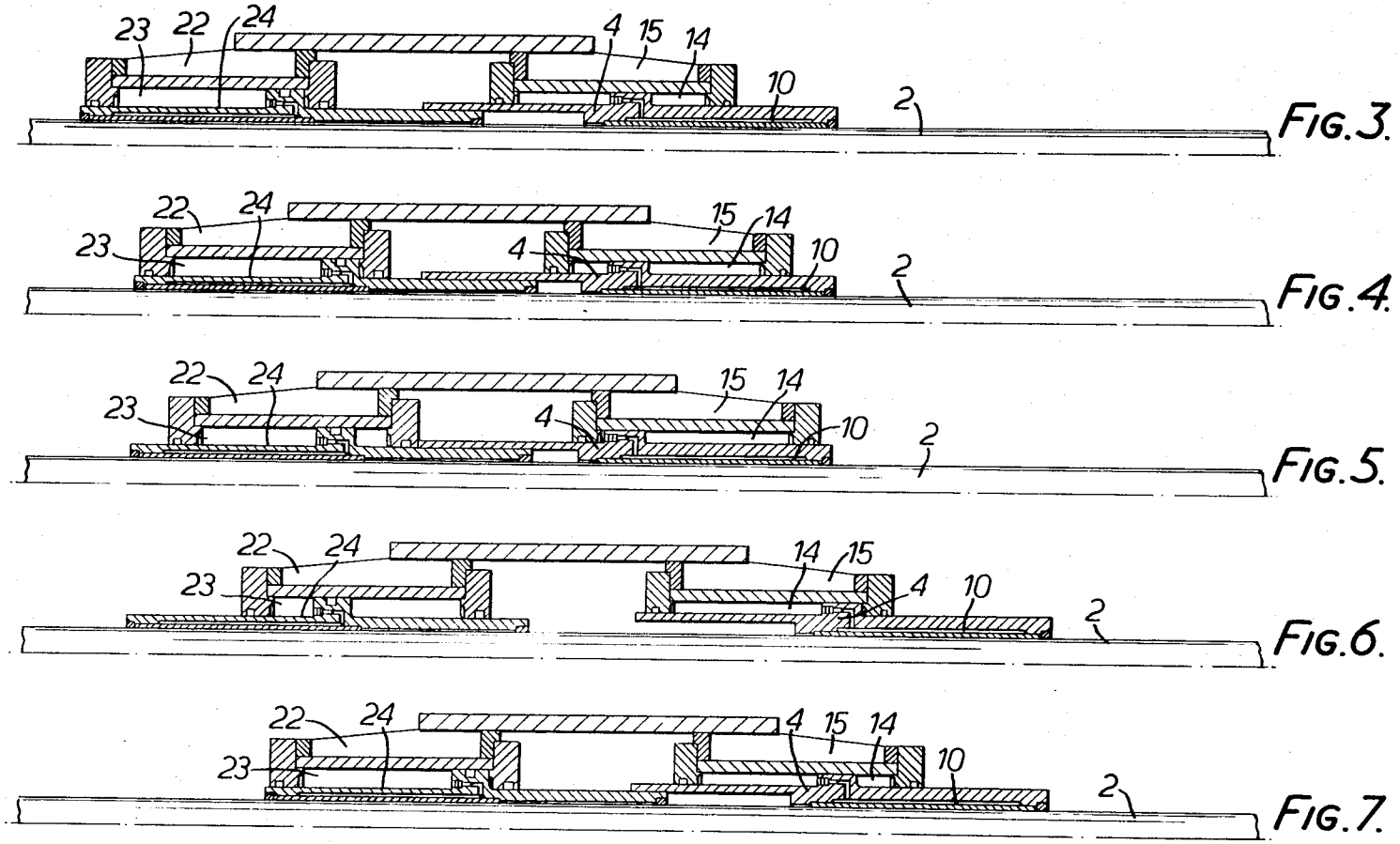

Fluid at a pressure of approximately 50 lbs/sq.in is supplied through non-return valves $Z_0$ to the ports 18 and 34 of the cylinders thus displacing the two pistons to the right-hand ends of the respective cylinders. With the valve X in the position shown in FIG. 1, fluid at a high pressure, 2000 lbs/sq.in, is supplied through the port 16 into the right-hand end of the cylinder 14. The piston 4 is prevented from moving to the left by the fluid which is locked in the left-hand portion of the cylinder by the non-return valve $Z_0$. The blow-off valve $Z_1$ is set so as to maintain the piston stationary in the cylinder for sufficient time to enable the sheath 12 to be displaced into rigid engagement with the rod by the high pressure fluid in the recess 10. The high pressure fluid in the right-hand side of the cylinder then causes the housing 15 to be displaced to the right relative to the piston, the housing 22 being displaced with it, since the two housings are connected together mechanically. The piston 24 is not, at this time, clamped to the rod 2 by way of its sleeve 28 and the pressure of the fluid in the left-hand portion of the cylinder 23 maintains the piston 24 at the right-hand end of that cylinder so both cylinder 23 and piston 24 move together to the right. As the left-hand end wall of the cylinder 14 moves towards the stationary piston, the fluid in the left-hand side of the piston is compressed sufficiently for the valve $Z_1$ to blow-off allowing the fluid to escape. This position is shown in FIG. 3.

As the end wall of cylinder 14 approaches still nearer to the piston, this will be detected by the detector b which produces a signal which is applied to the valve X causing the valve to move to its intermediate position. In this position, the fluid pressure to the right-hand side of the cylinder 14 is maintained causing the cylinder to continue to move relative to the piston but, at the same time, the high pressure fluid is applied to the port 32 and into the cylinder 23. The high pressure applied to the cylinder 23 immediately causes the piston in the cylinder 23 to be clamped to the rod by way of the sleeve 28 and so, at this time, both pistons are clamped to the rod. This position is shown in FIG. 4. As the end wall of the cylinder 14 comes still closer to the piston 4, as shown in FIG. 5, the detector b associated with cylinder 14 produces a signal which causes the third section of the valve X to be operated and, in this section, the right-hand end of the cylinder 14 is connected to tank but the fluid under pressure continues to be supplied to the cylinder 23 and the piston in that cylinder remains secured to the rod. Consequently, the cylinder 23 is moved to the right relative to the piston causing the cylinder 14 also to move to the right. In this way, the two cylinders continue to move together to the right along the length of the rod. The piston 4 is displaced by the low pressure fluid present in the cylinder to the right-hand end of the cylinder, as shown in FIG. 6. When the left-hand end wall of the cylinder 23 approaches the fixed piston in that cylinder, the detector b on the cylinder 23 causes the valve X to move back to its intermediate position in which fluid under pressure is applied to both cylinders. In this position, both the pistons are clamped to the rod by their respective sheaths and the cylinder 23 continues to move to the right. Finally, as the piston 24 comes close to the left-hand end of its cylinder, the detector b causes the valve X to be operated to its original position in which the right-hand end of cylinder 14 receives high pressure fluid and the right-hand end of the cylinder 23 is connected to tank. Since there is a low pressure on the left-hand side of the piston 24, the piston is displaced in the cylinder to the right-hand end and thereby takes up a position, as shown in FIG. 7, which is ready for the next operating cycle.

In all cases, the low pressure continuously applied to the cylinders is insufficient to cause the piston to be clamped to the rod but it does act as a buffer to displace the piston along the rod with the movement of the cylinder.

Figure 8:
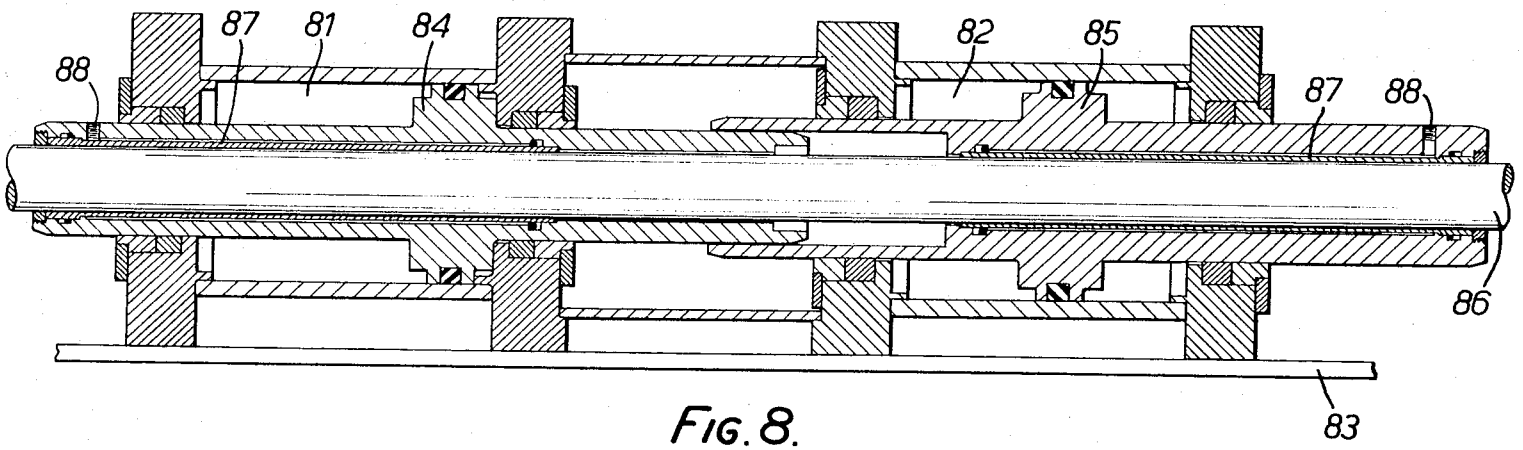
FIG. 8 is a diagrammatic cross sectional elevation of an alternative embodiment of the invention.

In the embodiment shown in FIG. 8, the two cylinders 81 and 82 are fixed to a stationary support 83 and each contain a piston 84, 85. The two pistons are mounted on a rod 86 and each cylinder has a fluid port at each end. Each piston has a clamping sheath 87 which can be forced by fluid under pressure to grip the rod 86. In this embodiment, the fluid under pressure to operate the clamping mechanism is supplied by way of an opening 88 positioned at one end of each piston and located outside the cylinder in all positions of the piston relative to the cylinder. In this way, there is no need to provide any form of connection between the interior of the cylinder and the recess which is closed off by the clamping sheath.

The operation of the apparatus is as described above where the cylinders remain stationary and, by introducing fluid under pressure in sequence into the cylinders and clamping the pistons in turn to the rod, the rod can be moved continuously in the direction of its length relative to the fixed cylinders. When it is desired to reverse the direction of movement of the rod, the high pressure fluid is supplied to the opposite ends of the cylinders and the low pressure fluid to the ends of the cylinders previously supplied with the high pressure fluid.

Obviously, many modifications and variations of the present invention are possible in light of the above teachings. It is therefore to be understood that within the scope of the appended claims, the present invention may be practiced otherwise than as specifically described herein.

I claim:

1. A piston-cylinder assembly, comprising:

a rod;

a pair of pistons relatively movable with respect to said rod;

clamping means for clamping each of said pair of pistons to said rod;

a pair of cylinders, relatively movable with respect to said rod, for housing said pair of pistons, respectively;

means for introducing and exhausting pressurized fluid to and from said pair of cylinders and said pair of piston clamping means; and means cyclically controlling the flow of said pressurized fluid to and from said pair of cylinders and said pair of piston clamping means for moving said pair of pistons relative to said pair of cylinders and sequentially actuating only a first one of said pair of piston clamping means, both of said pair of piston clamping means, only the second one of said pair of piston clamping means, both of said pair of piston clamping means, and only said first one of said pair of piston clamping means, so as to provide said relative movement between said pair of cylinders and said rod.

2. A piston-cylinder assembly as claimed in claim 1, wherein each piston has a sleeve portion which fits on the rod and an annular portion surrounding the sleeve portion, said cylinder being mounted on the sleeve portion with the annular portion within the cylinder.

3. A piston-cylinder assembly as claimed in claim 1, wherein said clamping means for each piston comprises a flexible sheath which surrounds the rod and closes off a recess in the piston, and means for introducing fluid under pressure into the recess.

4. A piston-cylinder assembly as claimed in claim 3, in which the flexible sheath is of bronze.

5. A piston-cylinder assembly as claimed in claim 4, wherein the means for introducing fluid under pressure into the recess in each piston comprises a bore connecting the recess with the cylinder with which the piston is associated and a pressure intensifier located in the bore such that fluid in the cylinder, at a pressure exceeding a predetermined value, causes the pressure of the fluid in the recess to be such as to cause the sheath to grip the rod to clamp the piston thereto.

6. A piston-cylinder assembly as claimed in claim 1, including means for detecting the position of the piston relative to the cylinder.

7. A piston-cylinder assembly as set forth in claim 6, wherein:

said detecting means comprises a detector disposed within an end wall of each cylinder for detecting the relative position of said cylinder wall with respect to said piston disposed within said cylinder.

8. A piston-cylinder assembly as claimed in claim 1, in which the rod is fixed and the cylinders are displaceable together relative to the rod.

9. A piston-cylinder assembly as claimed in claim 1, in which the cylinders are fixed and the rod is movable in the direction of its length relative to the cylinders.

10. A piston-cylinder assembly as claimed in claim 8 or 9, in which there are two pistons and two cylinders and each cylinder has means for detecting the position of the piston within the cylinder, valve means for introducing low pressure fluid into each cylinder and valve means for introducing high pressure fluid into each cylinder.

11. A piston-cylinder assembly as claimed in claim 10, in which the valve means through which the high pressure fluid is introduced into the cylinders includes a three position valve operable by said detecting means such that, in an operating sequence, fluid is applied to one cylinder, to both cylinders, and to the other cylinder to bring about continuous relative movement between the rod and the cylinders.

12. A piston-cylinder assembly as set forth in claim 1, wherein:

said means for introducing and exhausting said pressurized fluid comprises a source of high-pressure fluid and a source of low-pressure fluid.

13. A piston-cylinder assembly as set forth in claim 12, further comprising:

non-return valve means operatively associated with said low-pressure fluid source.

14. A piston-cylinder assembly as set forth in claim 12, further comprising:

blow-off valve means operatively associated with said low-pressure fluid source.

15. A piston-cylinder assembly as set forth in claim 1, wherein:

said means for controlling the flow of said pressurized fluid comprises a three-position valve.

16. A piston-cylinder assembly as set forth in claim 15, further comprising:

position detecting means for detecting the position of each of said pistons relative to said cylinders and for controlling said three-position valve in response to said detected positions.

* * * * *